US007994761B2

(12) United States Patent
Markowski et al.

(10) Patent No.: US 7,994,761 B2
(45) Date of Patent: Aug. 9, 2011

(54) LINEAR REGULATOR WITH RF TRANSISTORS AND A BIAS ADJUSTMENT CIRCUIT

(75) Inventors: Piotr Markowski, Ansonia, CT (US); Lin Guo Wang, Nanjing (CN)

(73) Assignee: Astec International Limited, Kwun Tong, Kowloon (HK)

( * ) Notice: Subject to any disclaimer, the term of this patent is extended or adjusted under 35 U.S.C. 154(b) by 203 days.

(21) Appl. No.: 11/868,667

(22) Filed: Oct. 8, 2007

(65) Prior Publication Data

US 2009/0091305 A1 Apr. 9, 2009

(51) Int. Cl.
*G05F 1/565* (2006.01)
*G05F 1/595* (2006.01)

(52) U.S. Cl. ..... 323/270; 323/274; 323/275

(58) Field of Classification Search ..... 323/269, 323/270, 273–275, 280, 281, 266; 330/262, 330/269, 271, 273
See application file for complete search history.

(56) References Cited

U.S. PATENT DOCUMENTS

| | | | | |
|---|---|---|---|---|
| 3,600,667 | A | 8/1971 | Wynn | |
| 3,970,953 | A | 7/1976 | Walker et al. | |
| 4,378,530 | A | 3/1983 | Garde | |
| 4,502,152 | A | 2/1985 | Sinclair | |
| 4,516,080 | A | 5/1985 | Garde | |
| 5,682,303 | A | 10/1997 | Goad | |
| 5,905,407 | A | 5/1999 | Midya | |
| 5,939,867 | A * | 8/1999 | Capici et al. | 323/277 |
| 6,009,000 | A | 12/1999 | Siri | |
| 6,043,707 | A | 3/2000 | Budnik | |
| 6,053,707 | A | 4/2000 | Itsuji et al. | |
| 6,121,761 | A | 9/2000 | Herbert | |
| 6,215,290 | B1 | 4/2001 | Yang et al. | |
| 6,281,666 | B1 | 8/2001 | Tressler et al. | |
| 6,292,378 | B1 | 9/2001 | Brooks et al. | |
| 6,300,826 | B1 | 10/2001 | Mathe et al. | |
| 6,346,798 | B1 | 2/2002 | Passoni et al. | |
| 6,362,607 | B1 | 3/2002 | Wickersham et al. | |
| 6,362,608 | B1 | 3/2002 | Ashburn et al. | |
| 6,404,175 | B1 | 6/2002 | Yang et al. | |
| 6,424,129 | B1 | 7/2002 | Lethellier | |

(Continued)

FOREIGN PATENT DOCUMENTS

WO WO 00/08750 A1 2/2000

(Continued)

OTHER PUBLICATIONS

Pritiskutch, J., & Hanson, B. Understanding LDMOS Device Fundamentals. STMicroelectronics Application Note AN1226. Jul. 2006. Retrieved on Feb. 22, 2010 from http://www.st.com/stonline/books/pdf/docs/6968.pdf.*

(Continued)

*Primary Examiner* — Adolf Berhane
*Assistant Examiner* — Fred E Finch, III
(74) *Attorney, Agent, or Firm* — K&L Gates LLP

(57) ABSTRACT

A regulator comprising a linear regulator. The linear regulator may comprise a preamplifier, a first radio frequency (RF) transistor and a second radio frequency (RF) transistor. An output of the preamplifier stage may be provided to a biasing terminal of the first RF transistor and a biasing terminal of the second RF transistor. Also, the first and second RF transistors may be electrically connected in series between a positive supply voltage and a negative supply voltage.

14 Claims, 7 Drawing Sheets

U.S. PATENT DOCUMENTS

| | | | | |
|---|---|---|---|---|
| 6,449,174 | B1 | 9/2002 | Elbanhawy | |
| 6,509,722 | B2 * | 1/2003 | Lopata | 323/280 |
| 6,534,962 | B1 | 3/2003 | Lee | |
| 6,583,664 | B2 | 6/2003 | Mathe et al. | |
| 6,642,631 | B1 | 11/2003 | Clavette | |
| 6,650,096 | B2 | 11/2003 | Lee | |
| 6,661,210 | B2 | 12/2003 | Kimball et al. | |
| 6,674,274 | B2 | 1/2004 | Hobrecht et al. | |
| 6,781,452 | B2 | 8/2004 | Cioffi et al. | |
| 6,806,690 | B2 * | 10/2004 | Xi | 323/273 |
| 6,825,726 | B2 | 11/2004 | French et al. | |
| 6,833,760 | B1 | 12/2004 | Aude | |
| 6,850,045 | B2 | 2/2005 | Muratov et al. | |
| 6,894,559 | B1 | 5/2005 | Dolman | |
| 6,992,353 | B1 * | 1/2006 | Wu | 257/335 |
| 7,058,373 | B2 | 6/2006 | Grigore | |
| 7,071,662 | B2 | 7/2006 | Hsu et al. | |
| 7,091,777 | B2 | 8/2006 | Lynch | |
| 7,109,689 | B2 | 9/2006 | Schneider | |
| 7,116,946 | B2 | 10/2006 | Tanabe et al. | |
| 7,126,315 | B2 | 10/2006 | Seo | |
| 7,126,317 | B2 * | 10/2006 | Schreck | 323/282 |
| 7,183,755 | B2 * | 2/2007 | Itoh et al. | 323/274 |
| 7,183,856 | B2 | 2/2007 | Miki et al. | |
| 7,190,150 | B2 | 3/2007 | Chen et al. | |
| 7,391,192 | B2 * | 6/2008 | Ostrom et al. | 323/274 |
| 7,499,502 | B2 | 3/2009 | Morimoto et al. | |
| 7,551,688 | B2 | 6/2009 | Matero et al. | |
| 7,583,149 | B2 | 9/2009 | Funaki et al. | |
| 7,602,155 | B2 | 10/2009 | Markowski | |
| 2002/0046354 | A1 * | 4/2002 | Ostrom et al. | 713/300 |
| 2005/0110562 | A1 | 5/2005 | Robinson et al. | |
| 2006/0040452 | A1 * | 2/2006 | Lotfi et al. | 438/305 |
| 2006/0119425 | A1 | 6/2006 | Phillips et al. | |
| 2007/0019446 | A1 | 1/2007 | O'Loughlin | |
| 2007/0024360 | A1 | 2/2007 | Markowski | |
| 2007/0126408 | A1 * | 6/2007 | Sakai | 323/274 |
| 2008/0030174 | A1 * | 2/2008 | Niiyama | 323/274 |
| 2008/0237705 | A1 * | 10/2008 | Theeuwen et al. | 257/343 |
| 2009/0261908 | A1 | 10/2009 | Markowski | |

FOREIGN PATENT DOCUMENTS

WO WO 2007/107728 A1 9/2007

OTHER PUBLICATIONS

Holland, P.M., & Igic, P.M. An Alternative Process Architecture for CMOS Based High Side RESURF LDMOS Transistors. From Proc. 25th International Conference on Microelectronics, pp. 195-198. May 14-17, 2006. Retrieved from IEEE Xplore, doi:10.1109/ICMEL.2006.1650929.*

Datasheet for DE150-501N04A RF Power MOSFET. IXYS RF document #9200-0240 Rev 3. 2003. Retrieved from http://datasheet.octopart.com/DE150-501N04A-IXYS-datasheet-8646833.pdf on Jul. 8, 2010.*

Notice of Allowance issued on Mar. 11, 2009 in U.S. Appl. No. 11/190,642.

Office Action issued on May 5, 2008 in U.S. Appl. No. 11/190,642.

Office Action issued on Oct. 30, 2008 in U.S. Appl. No. 11/190,642.

Restriction Requirement issued on Mar. 5, 2009 in U.S. Appl. No. 11/869,121.

U.S. Appl. No. 12/417,859, filed Apr. 3, 2009.

U.S. Appl. No. 11/869,121, filed Oct. 9, 2007.

Yundt, George B., "Series Parallel Connected Composite Amplifiers," Jun. 1983, Master Thesis, Massachusetts Institute of Technology, pp. 1-359.

Kashiwagi, Seigoh, "A High-Efficiency Audio Power Amplifier Using a Self-Oscillating Switching Regulator," IEEE Transactions on Industry Applications, Jul./Aug. 1985, vol. IA-21, No. 4, pp. 906-911.

Ertl et al., "Basic Considerations and Topologies of Switched-Mode Assisted Linear Power Amplifiers," Proc. of the 11th Applied Power Electronics Conference, IEEE, 1996, pp. 207-213.

van der Zee et al., "A Power Efficient Audio Amplifier Combining Switching and Linear Techniques," Proc. of the 24th European Solid-State Circuits Conference, 1998, pp. 288-291.

Yousefzadeh et al., "Band Separation and Efficiency Optimization in Linear-Assisted Switching Power Amplifiers," Proc. of the 37th Power Electronics Specialists Conference, 2006, 7 pages.

Zhou et al., "Switch-Linear Hybrid Power Conversion (I)—The Topologies Based on Source Follower," IEEE, 2006, 7 pages.

Asbeck et al., "Synergistic Design of DSP and Power Amplifiers for Wireless Communications", IEEE Transactions on Microwave Theory and Techniques, Nov. 2001, vol. 49, No. 11, pp. 2163-2169.

Sahu et al., "System-Level Requirements of DC-DC Converters for Dynamic Power Supplies of Power Amplifiers", 2002 IEEE Asia-Pacific Conference on ASICS, 4 pages.

Sahu et al., "A High-Efficiency Linear RF Power Amplifier with a Power-Tracking Dynamically Adaptive Buck-Boost Supply," IEEE Transactions on Microwave Theory and Techniques, Jan. 2004, vol. 52, No. 1, pp. 112-120.

Hu et al., "Switch-Linear-Hybrid Power Converter and Its Application Prospect in Industry," IEEE, 2006, pp. 1009-1014.

Office Action issued on Jun. 12, 2007 in U.S. Appl. No. 11/190,642.

Office Action issued on Nov. 21, 2007 in U.S. Appl. No. 11/190,642.

Advisory Action Before the Filing of an Appeal Brief issued Aug. 14, 2008 in U.S. Appl. No. 11/190,642.

Restriction Requirement issued on Apr. 27, 2007 in U.S. Appl. No. 11/190,642.

Supplemental Notice of Allowability issued on Aug. 13, 2009 in U.S. Appl. No. 11/190,642.

Office Action issued on Jul. 22, 2009 in U.S. Appl. No. 11/869,121.

Notice of Allowance issued on Jan. 26, 2010 in U.S. Appl. No. 11/869,121.

Office Action issued on Jan. 5, 2010 in U.S. Appl. No. 12/417,859.

Office Action issued on Apr. 13, 2010 in U.S. Appl. No. 11/869,121.

European Search Report mailed Jan. 26, 2010 for Application No. 08712950,8, 4 pages.

Kimball et al., "50% PAE WCDMA Basestation Amplifier Implemented with GaN HFETs", Compound Semiconductor Integrated Circuit Symposium, 2005, CSIC '05, IEEE Palm Springs, CA, Oct. 30-Nov. 2, 2005, Piscataway, NJ, USA, IEEE, Oct. 30, 2005, 4 pages.

European Search Report mailed Feb. 19, 2010 for Application No. 10000151.0, 8 pages.

Larson et al., "Device and Circuit Approaches for Improved Wireless Communications Transmitters", IEEE Personal Communications, vol. 6, No. 5, Oct. 1999, pp. 18-23.

Adragna, Claudio, "AN1261 Application Note, Getting Familiar with the L6590 Family High-Voltage Fully Integrated Power Supply", Dec. 2001, 28 pages.

"L6569, L6569A, High Voltage Half Bridge Driver with Oscillator", Jun. 2000, 13 pages.

"SST823 SST824 High Speed N-Channel Lateral DMOS Switch Zener Protected", Linear Systems, Linear Integrated Systems, 2 pages.

"FSQ510, FSQ510H, and FSQ510M, Green Mode Fairchild Power Switch (FPS™) for Valley Switching Converter—Low EMI and High Efficiency", Fairchild Semiconductor®, Jan. 2009, 15 pages.

"NCP1000, NCP1001, NCP1002 Integrated Off-Line Switching Regulator", ON Semiconductor®, Semiconductor Components Industries, LLC, Jul. 2009, Rev. 10, 14 pages.

"CALMOS Technology, SD5000N High-Speed LDMOS Quad Fet Analog Switch Array", 3 pages.

"BCD Processes Overview", Towerjazz, 2 pages.

"TSMC High Voltage Technology", Taiwan Semiconductor Manufacturing Company Ltd., Apr. 2005, 4 pages.

Notice of Allowance issued on Aug. 13, 2010 in U.S. Appl. No. 11/869,121.

Notice of Allowance issued on Jun. 25, 2010 in U.S. Appl. No. 12/417,859.

* cited by examiner

LINEAR REGULATOR WITH RF TRANSISTORS AND A BIAS ADJUSTMENT CIRCUIT

BACKGROUND

The present disclosure relates to linear regulators. FIG. 1 illustrates a prior art linear regulator 100. The regulator 100 includes a preamplifier stage 102 and an output stage 104. The preamplifier stage 102 includes a preamplifier 106, which may include a set of discrete components, or may be realized as a fully integrated circuit. An input signal is provided to an input terminal 101 of the preamplifier 106. The output of the preamplifier 106 is provided to a pair of discrete power transistors 108, 110 arranged in a push-pull configuration. The proper bias (dc operating point) of transistors 108, 110 is provided by a pair of regulated voltage generating circuits 114, 116. The voltage generated by the circuits 114, 116 is selected to cancel the non-active input voltage region of the transistors 108, 110 at low input voltage levels. The transistors 108, 110 are of opposite types. Transistor 108 is an n-type power Field Effect Transistor (FET) or an npn-type power bipolar transistor, while transistor 110 is a p-type power FET or a pnp-type power bipolar transistor. An output terminal 103 is provided at the junction between transistor 108 and the transistor 110. A feedback line 112 provides a feedback signal to the preamplifier 106, causing it to amplify the difference between the input and output voltages. When the output voltage of the preamplifier 106 is below the input voltage, the output of the preamplifier 106 goes up and the transistor 108 is biased on, sourcing current to any load present at the output terminal 103 and bringing the output voltage to the desired level. The transistor 110 is in cut-off. When the output voltage of the preamplifier 106 is above the input voltage, the output of the preamplifier 106 goes down and the transistor 110 is biased on, sinking current from any load present at the output terminal 103 and thus bringing the output voltage to the desired level. The transistor 108 is in cut-off.

SUMMARY

In one general aspect, the present invention may be directed to embodiments of a regulator comprising a linear regulator. The linear regulator may comprise a preamplifier, a first radio frequency (RF) transistor and a second radio frequency (RF) transistor. An output of the preamplifier stage may be provided to a biasing terminal of the first RF transistor and a biasing terminal of the second RF transistor. Also, the first and second RF transistors may be electrically connected in series between a positive supply voltage and a negative supply voltage.

In another general aspect, the present invention may be directed to embodiments of a regulator comprising a linear regulator. The linear regulator may comprise a preamplifier stage, an output stage and a bias adjustment circuit. The bias adjustment circuit may be configured to sense a bias current of the output stage if the output current of the output stage is substantially equal to zero, and compare the bias current to a reference bias current. If the bias current does not have a predetermined relationship to the reference bias current, then the bias adjustment circuit may be configured to modify a dc shift of the output of the preamplifier stage.

In yet another general aspect, various embodiments are directed to a hybrid linear-switching regulator comprising a switching regulator, a linear regulator, and a monitor circuit. The monitor circuit may be configured to monitor an time average current delivered by the linear regulator. If the time average current delivered by the linear regulator is greater than a predetermined threshold, then the monitor circuit may be configured to reduce a gain of the switching regulator. If the time average current delivered by the linear regulator is less than a second predetermined threshold, the monitor circuit may be configured to increase the gain of the switching regulator.

FIGURES

Embodiments of the present invention are described herein, by way of example, in conjunction with the following figures, wherein.

DESCRIPTION

Figure 1:
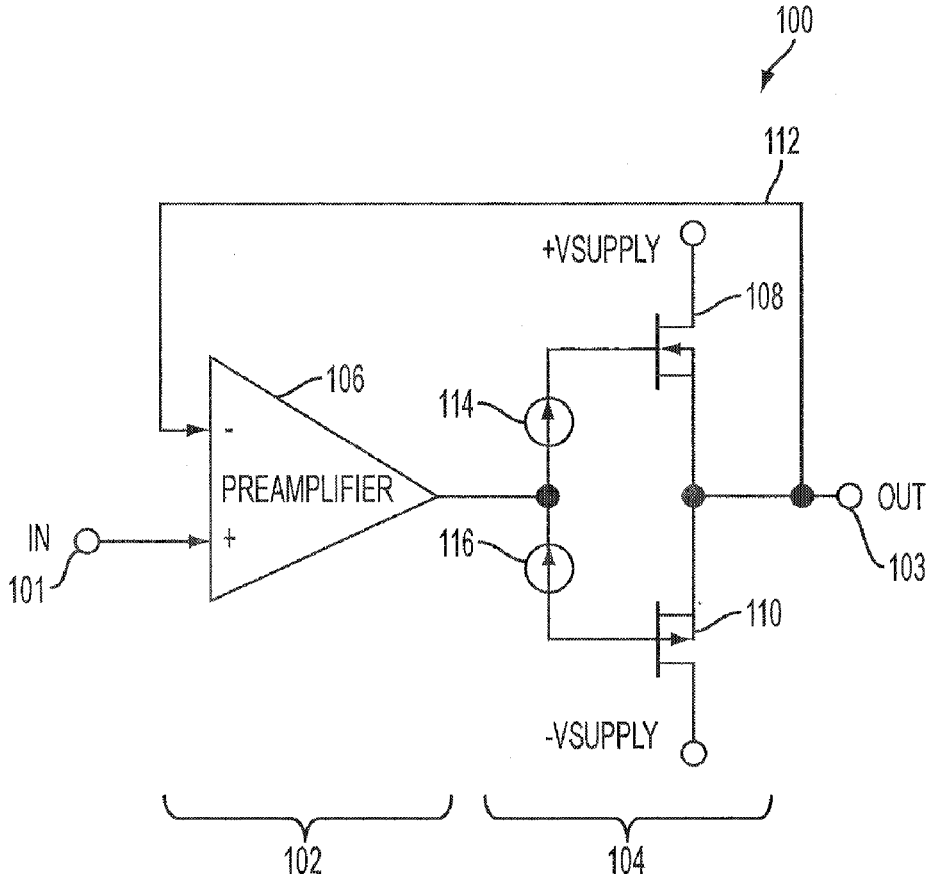
FIG. 1 PRIOR ART
FIG. 1 illustrates a prior art linear regulator.
Figure 2:
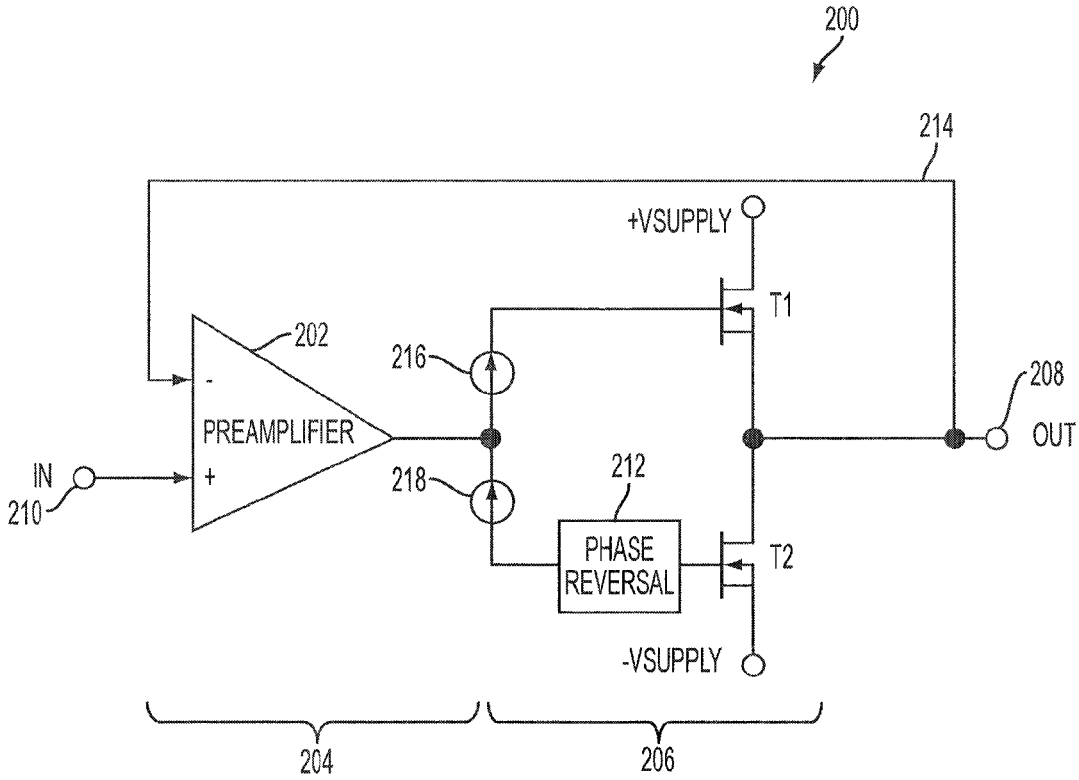
FIG. 2 illustrates one embodiment of a linear regulator.

FIG. 2 illustrates one embodiment of a linear regulator 200. The linear regulator 200 may be used as part of a hybrid linear-switching regulator, or may be used separately. According to various embodiments, the regulator 200 comprises a preamplifier stage 204 electrically connected to an output stage 206. An input signal may be provided at input terminal 210, while an output signal may be provided to a load at terminal 208. In the embodiment shown in FIG. 2, the preamplifier stage 204 comprises a single preamplifier 202, although more than one preamplifier may be included in parallel or series. The preamplifier 202 may perform all stages of amplification prior to the output stage 206. For example, the preamplifier 202 may perform low and medium power amplification.

The output stage 206 may comprise a pair of transistors T1, T2 and a phase reversal circuit 212. The transistors T1 and T2 may be any suitable type of transistor including, for example, Metal Oxide Field Effect Transistors (MOSFET's), Metal Semiconductor Field Effect Transistors (MESFET's), other field effect transistors (FET's), or bipolar transistors. T1 and T2 may be constructed from any suitable semiconductor material or materials including, for example, silicon, gallium arsenide (GaAs), etc. Biasing components 216, 218 may provide suitable biasing to T1 and T2. For example, when T1 and T2 are field effect transistors (FET's), the biasing components 216, 218 may act as simple voltage sources to provide at least a threshold voltage at the respective gates. In one embodiment, biasing components 216, 218 may comprise diodes with their respective anodes connected in series to the positive and negative supply voltages via resistors. Various other configurations may be used, however, including Zener diode circuits, resistor-capacitor circuits, etc. In embodiments where T1 and T2 are bipolar or other current-biased transistors, biasing components 216, 218 may provide at least a threshold current to the respective bases. For example, the biasing components 216, 218 may include resistor or transistor-based circuits.

According to various embodiments, T1 and T2 may be radio frequency (RF) transistors. RF transistors may be optimized for high frequency ac operation in the linear region. This may be accomplished by minimizing the parasitic capacitance at all of the transistor terminals and the parasitic resistance at the gate or base. This may allow RF transistors to change their operating state relatively quickly. One adverse result of the optimization of RF transistors is that they often suffer relatively higher losses when conducting direct current (dc). This is because of their relatively high on-resistance. In contrast to RF transistors, power transistors may be optimized to conduct current with minimal losses, for example, by minimizing on-resistance. Power transistors, however, may have higher parasitic capacitances and parasitic resistance at the gate or base, making it difficult for power transistors to change states relatively quickly. For example, a medium-size power transistor designed to dissipate between a few and a few tens of watts may have an on-resistance of about four to twenty mohms. A similarly sized 60V RF transistor may have an input capacitance of between about 20 and 200 pf and a feedback capacitance of between about 0.5 and 10 pf. These ranges are provided for example purposes only, and are not intended to be limiting.

According to various embodiments, T1 and T2 may be of the same type. For example, if T1 and T2 are FET's, then they may both be either n-type FET's or p-type FET's. If T1 and T2 are bipolar transistors, then they may both be either npn or pnp-type. T1 and T2 may also be radio frequency (RF) transistors.

The transistors T1 and T2 may be electrically connected in series between a positive supply voltage and a negative supply voltage. The output terminal 208 of the regulator 200 may be positioned at the common node of the transistors T1 and T2. In embodiments where T1 and T2 are FET's, the drain of T1 may be electrically connected to the positive supply voltage; the source of T1 may be electrically connected to the drain of T2 and the source of T2 may be electrically connected to the negative supply voltage. In embodiments where T1 and T2 are bipolar transistors, the collector of T1 may be electrically connected to the positive supply voltage; the emitter of T1 may be electrically connected to the collector of T2; and the emitter of T2 may be electrically connected to the negative supply voltage. A feedback line 214 may provide a feedback signal from the output terminal 208 to the preamplifier stage 204. The supply voltages may be chosen to be any suitable value including, for example, 12 volts, 15 volts, 5 volts, ground, etc.

The biasing terminals of T1 and T2 (e.g., for FET's, the gates and for bipolar transistors, the bases) may be electrically connected to the output of the preamplifier stage 204. In embodiments where T1 and T2 are of the same type, as shown in FIG. 2, T2 tends to reverse the phase of the signal received from the preamplifier stage 204. Accordingly, a phase reversal circuit 212 may be electrically connected between the preamplifier stage 202 and the biasing terminal of T2. The phase reversal circuit 212 may serve to shift the phase of the preamplifier stage output before it reaches T2. For example, the phase reversal circuit 212 may shift the phase of the preamplifier stage output by about 180° before the signal encounters T2. As a result, T1 and T2 may operate out of phase with one another causing T1 to source current when the input voltage is above zero and T2 to sink current when input voltage is below zero.

The phase reversal circuit 212 may be implemented by any suitable circuit component or components. For example, the phase reversal circuit 212 may comprise an inverting amplifier configuration with unity gain. One example of such a configuration could include an operational amplifier (Op-Amp) configured to invert and coupled with suitable components (e.g., resistors, capacitors etc.) to bring about unity gain. Another example of such a configuration could include a FET with its drain electrically connected to the positive supply voltage via a resistor, its gate electrically connected to the output of the preamplifier stage 202 and its source electrical connected to the biasing terminal of T2, for example via a second resistor. The resistances of the resistors could be chosen to achieve unity gain.

According to various embodiments, the phase reversal circuit 212 may have a non-unity gain associated with it. For example, in the regulator 200 as shown in FIG. 2, T1 and T2 may exhibit substantially different voltage gains. The gain of the phase reversal circuit 212 may be selected, for example, such that the gain of the phase reversal circuit 212 plus T2 is substantially equal to the gain of T1.

Figure 3:
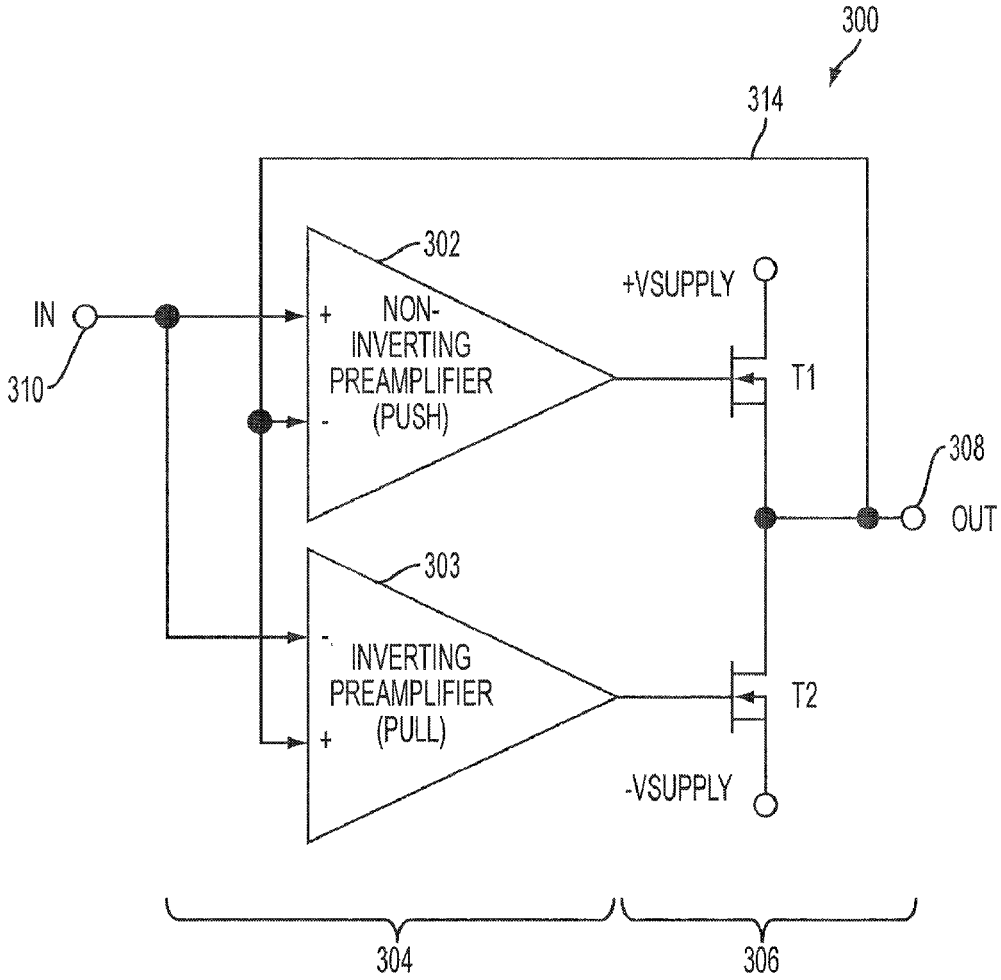
FIG. 3 illustrates one embodiment of a linear regulator having a preamplifier stage comprising a pair of preamplifiers.

FIG. 3 illustrates one embodiment of a linear regulator 300 having a preamplifier stage 304 comprising a pair of preamplifiers 302 and 303. The regulator 300 may be used as part of a hybrid linear-switching regulator, or may be used separately. A non-inverting preamplifier 302 may receive the signal from input terminal 310 at a non-inverting input, while an inverting preamplifier 303 may receive the signal from the input terminal 310 at an inverting input. Accordingly, the outputs of the respective preamplifiers 302, 303 may be reversed in phase.

Also, the outputs of the respective preamplifiers 302, 303 may be electrically connected to the biasing terminals of T1 and T2. The output of the non-inverting preamplifier 302 may be electrically connected to the biasing terminal of T1, while the output of the inverting preamplifier 303 may be electrically connected to the biasing terminal of T2. Because the output of the preamplifier 303 is inverted, a phase reversal circuit, such as circuit 212 above, may not be necessary in the regulator 300. Also, because T1 and T2 are driven by separate preamplifiers 302, 303, any differences between the voltage gains of T1 and T2 may be addressed by modifying the gains of the respective preamplifiers 302, 303. In various embodiments, T1 and T2 may be otherwise connected in a manner similar to that shown above with respect to the regulator 200. For example, T1 and T2 may be electrically connected in series between a positive supply voltage and a negative supply voltage. Again, the output terminal 308 of the regulator 300 may be positioned at the common node of T1 and T2; and a feedback line 314 may provide a feedback signal from the output terminal 308 to the preamplifier stage 304.

Figure 4:
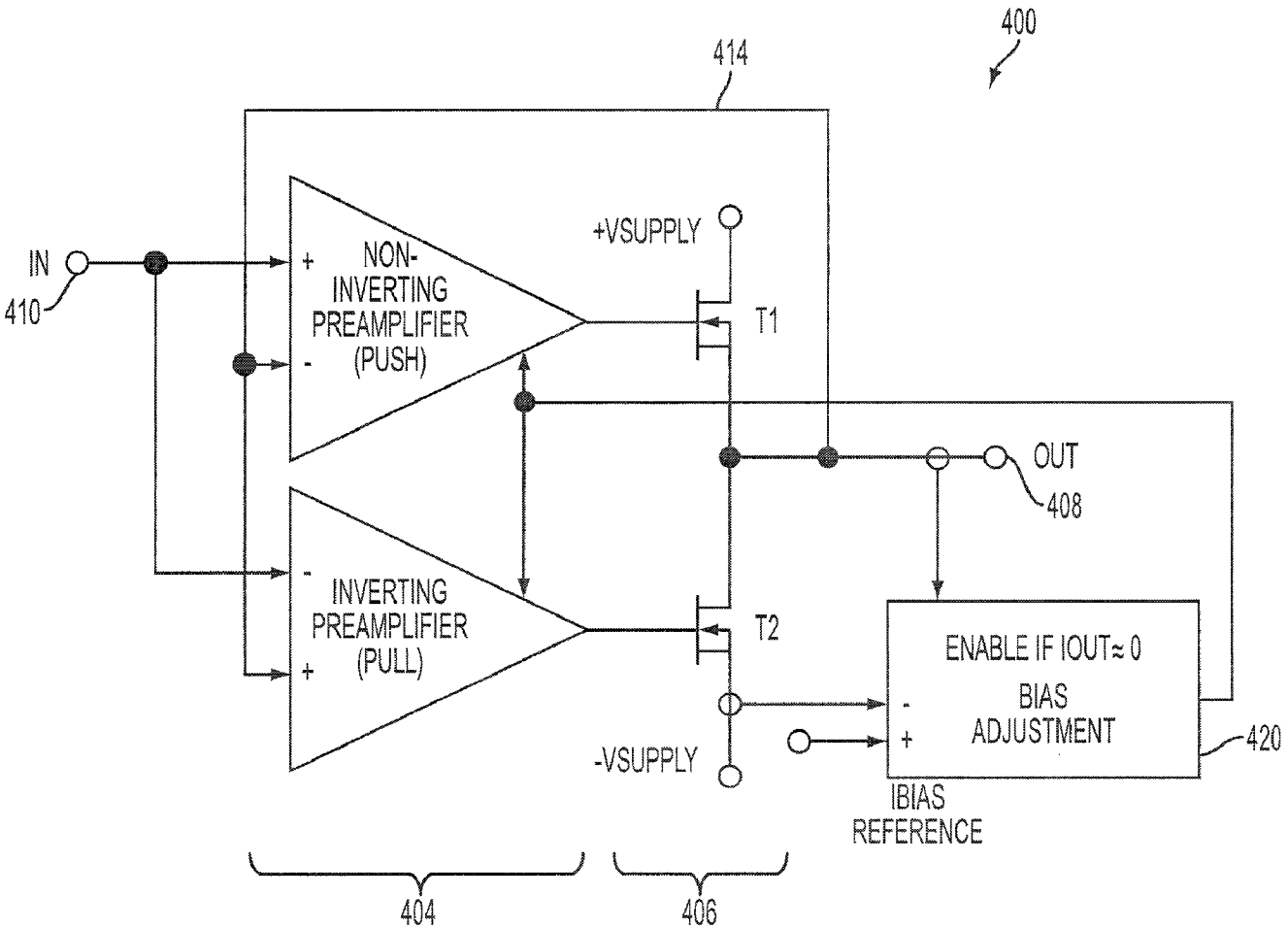
FIG. 4 illustrates one embodiment of a linear regulator comprising a bias adjustment circuit.

FIG. 4 illustrates one embodiment of a linear regulator 400 comprising a bias adjustment circuit 420. The regulator 400 may be used as part of a hybrid linear-switching regulator, or may be used separately. The bias adjustment circuit 420 may correct for bias current drift. The regulator 400 may comprise a preamplifier stage 404 and an output stage 406. FIG. 4 illustrates a preamplifier stage 404 and output stage 406 as described above with respect to the regulator 300. It will be appreciated, however, than any suitable preamplifier and output stage configuration may be used including, for example, the preamplifier stage 102 and output stage 104 and/or the preamplifier stage 204 and output stage 206.

The bias adjustment circuit 420 may receive as inputs a reference bias current, an indication of the current biasing the transistors T1 and T2, as well as an indication of the output current. The bias current may be measured at any suitable point within the circuit including, for example, between the transistor T2 and the negative supply voltage, or between the transistor T1 and the positive supply voltage. The current at these locations may be an accurate representation of the bias current when the output current is equal to about zero. The output current may be equal to about zero during operation of the regulator 400, for example, when the regulator 400 is used in conjunction with a switching regulator to form a hybrid regulator. In such a configuration, the switching regulator would drive the output for relatively low frequency signals, while the linear regulator 400 would drive the output for relatively high frequency signals. When the input signal lacks a relatively high frequency component, and the voltage produced by the switching regulator is accurate, the output current of the linear regulator 400 would be about zero, allowing the bias current of the output stage 406 to be measured. For example, the circuit 420 may sense the bias current and compare it to the reference bias current. If the bias current does not match, or otherwise have a predetermined relationship to the reference bias current, then the circuit 420 may make adjustments to the regulator 400 to correct the bias current. For example, the circuit 420 may modify a dc shift of the output of the preamplifier stage 404.

Figure 4A:
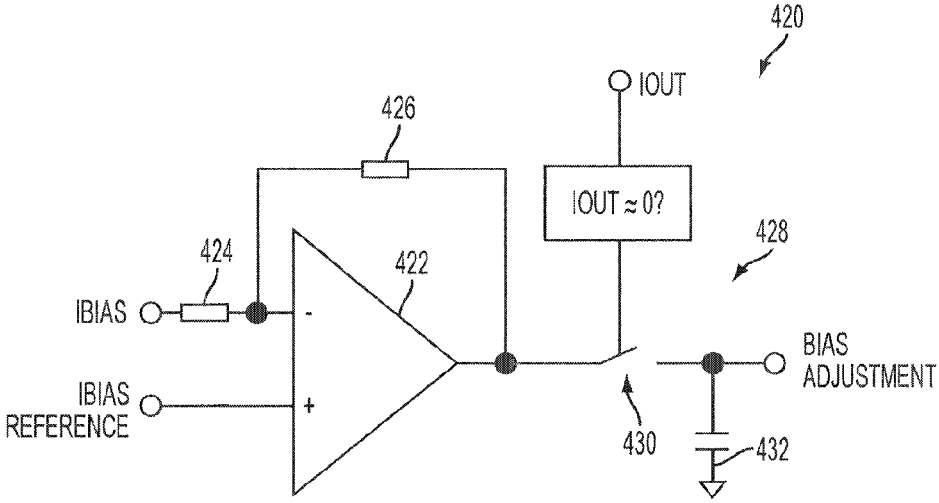
FIG. 4A illustrates one embodiment of an analog bias adjustment circuit.

The bias adjustment circuit 420 may be designed according to any suitable configuration having the desired functionality. For example, the bias adjustment circuit may comprise a microprocessor, state machine, or other digital circuit. According to other embodiments, the circuit 420 may be implemented as an analog circuit. FIG. 4A illustrates one embodiment of an analog bias adjustment circuit 420. The circuit 420 may include op-amp 422 in a reversing amplifier configuration. A signal representing the reference bias current (Ibias reference) may be applied to the positive input of the op-amp 422 and a signal representing the measured bias current (Ibias) may be applied to the negative input of an op-amp 422 via an appropriate gain setting network including elements 424, 426. A sample and hold circuit 428 may be positioned at the output of an op-amp 422. For example, the sample and hold circuit 428 may comprise a switch 430 and capacitor 432, as shown. The switch 430 may be activated (made conductive) only when the output current is essentially equal to zero, which updates the voltage of the capacitor 432. During the periods when output current of the linear regulator 400 is not essentially equal to zero the switch 430 is deactivated (in high impedance) thus effectively isolating the capacitor 432. This capacitor 432 maintains the voltage until the next instance during which output current is essentially equal zero and its voltage can be updated.

Figure 5:
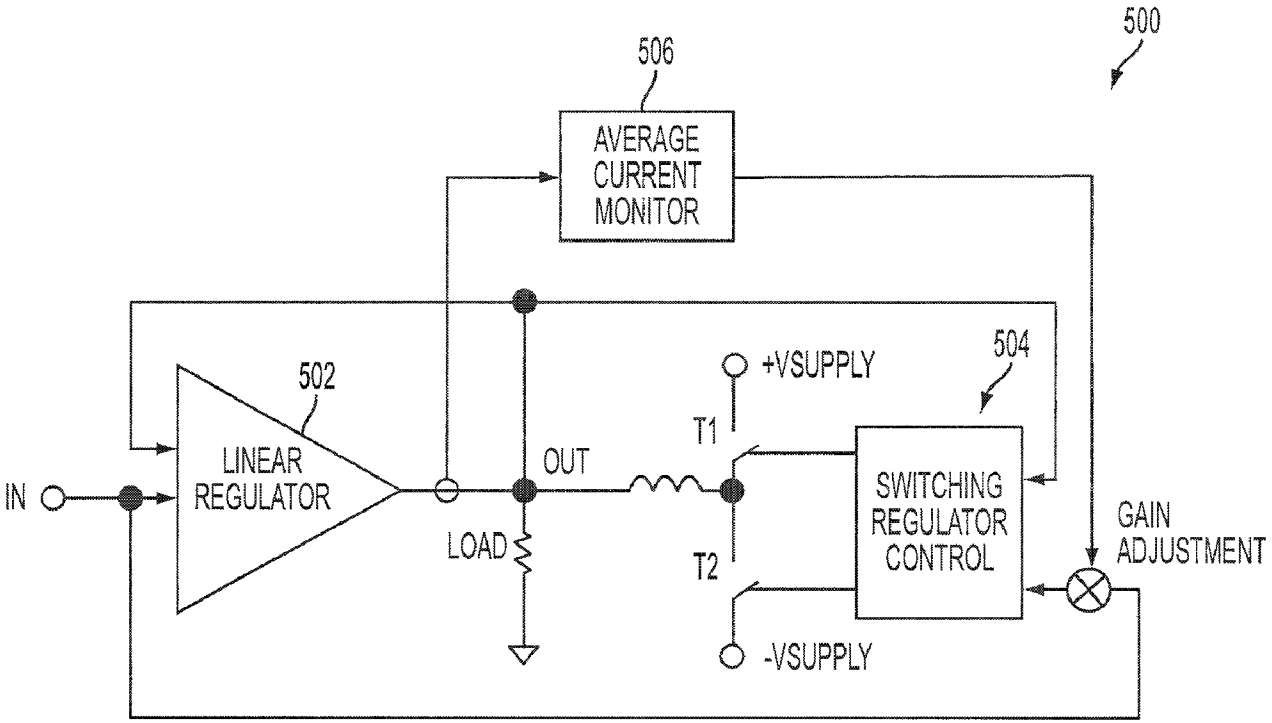
FIG. 5 illustrates one embodiment of a hybrid regulator comprising a linear regulator, a switching regulator and an average current monitor.

FIG. 5 illustrates one embodiment of a hybrid regulator 500 comprising a linear regulator 502, a switching regulator 504 and an average current monitor 506. The linear regulator 502 may be any suitable type of linear regulator including, for example, one or more of the linear regulators 100, 200, 300 and 400 described above. The switching regulator 504 may be any suitable type of switching regulator or any type regulator designed to operate in high current applications.

In a hybrid regulator, it may be desirable to match the voltage output of the linear regulator 502 and the switching regulator 504 to prevent one regulator (e.g., the switching regulator 504) from driving the output and negating the contribution of the other regulator. The voltage match between the regulators 502, 504 may be monitored by monitoring the average current delivered to a load. A positive average current coming out of the linear regulator 502 may indicate that the voltage of the switching regulator 504 is too low, on average, while a negative average current coming out of the linear regulator 502 may indicate that the voltage of the switching regulator 504 is to high, on average. The average current monitor circuit 506 may monitor the average current and make appropriate adjustments to the gain of the switching regulator 504, as shown in FIG. 5. For example, if the average current from the linear regulator 502 is more negative than a first predetermined threshold, then the average current monitor circuit 506 may reduce the gain of the switching regulator 504. If the average current is more positive than a second predetermined threshold, then the circuit 506 may increase the gain of the switching regulator 504. According to various embodiments, the first predetermined threshold may be equal to the second predetermined threshold. One or both of the predetermined thresholds may be equal to zero. It will be appreciated that the circuit 506 may make adjustments to the gain of the linear regulator 502 in addition to or instead of adjusting the switching regulator. In this case, the direction of the change would be reversed.

Figure 6:
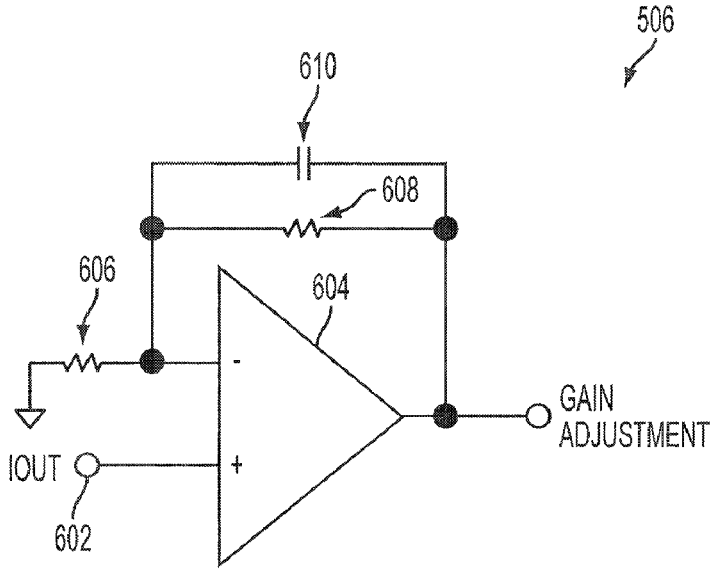
FIG. 6 illustrates one embodiment of an analog current monitor circuit.

The average current monitor circuit 506 may be implemented according to any suitable design. For example, the circuit 506 may be implemented as a microprocessor, state machine or other digital circuit having the functionality described above. Also, according to various embodiments, the current monitor circuit 506 may be implemented as an analog circuit. For example, FIG. 6 illustrates one embodiment of an analog current monitor circuit 506. The circuit 506 may include an operational amplifier 604 (op-amp) in a non-inventing amplifier configuration with a capacitor 610 in a feedback path performing time averaging. A signal indicative of the output current is provided at the non-inverting input 602 of the op-amp 604. For example, the signal may be the result of applying the output current to a current sensing resistor (not shown). The values of the resistors 606, 608 and the capacitor 610 may be selected to cause the circuit 506 to make an appropriately scaled adjustment to the gain of the regulator 504. The value of the capacitor 610 may be selected to choose the time span over which the time-averaging is performed. When the time average of the output current is positive, an appropriate positive adjustment to the gain of the regulator 504 may be performed. When the time average of the output current is negative, then a negative adjustment (reduction) of the gain of the regulator 504 may be performed.

It is to be understood that the figures and descriptions of the present invention have been simplified to illustrate elements that are relevant for a clear understanding of the present invention, while eliminating, for purposes of clarity, other elements. Those of ordinary skill in the art will recognize that these and other elements may be desirable. However, because such elements are well known in the art and because they do not facilitate a better understanding of the present invention, a discussion of such elements is not provided herein.

Various functionality of the regulators 200, 300, 400 and 500 may be implemented as software code to be executed by a processor(s) of any other computer system using any type of suitable computer instruction type. The software code may be stored as a series of instructions or commands on a computer readable medium. The term "computer-readable medium" as used herein may include, for example, magnetic and optical memory devices such as diskettes, compact discs of both read-only and writeable varieties, optical disk drives, and hard disk drives. A computer-readable medium may also include memory storage that can be physical, virtual, permanent, temporary, semi-permanent and/or semi-temporary.

We claim:

1. A regulator comprising:

a linear regulator comprising:

a preamplifier stage;

a first radio frequency (RF) transistor;

a second RF transistor, wherein the first RF transistor and the second RF transistor are of the same type, wherein an output of the linear regulator is electrically connected to an input of the preamplifier stage, and wherein the first RF transistor and the second RF transistor are electrically connected in series between a positive supply voltage and a negative supply voltage; and a phase reversal circuit electrically connected between the preamplifier stage and a biasing terminal of the second RF transistor and configured to shift the phase of an output of the preamplifier by about 180°, wherein an output of the preamplifier stage is provided to a biasing terminal of the first RF transistor and to the phase reversal circuit, wherein the first and second RF transistors are connected such that:

when an input to the preamplifier stage is greater than the output of linear regulator, the first RF transistor sources current to a load to drive the output of the linear regulator higher;

when the input to the preamplifier stage is less than the output of the linear regulator, the second RF transistor sinks current from the load to drive the output of the linear regulator lower; and when an output current either sourced by the first RF transistor or sunk by the second RF transistor is equal to zero, the first RF transistor and the second RF transistor have a non-zero bias current; and a bias adjustment circuit electrically connected to sense a bias current of at least one of the group consisting of the first RF transistor and the second RF transistor if an output current of the linear regulator is about zero, wherein the bias adjustment circuit is configured to:

compare the bias current to a reference bias current; and modify a dc shift of the output of the preamplifier stage when the bias current of the second transistor does not have a predetermined relationship to the reference bias current.

2. The regulator of claim 1, wherein an output of the linear regulator is taken between the first RF transistor and the second RF transistor.

3. The regulator of claim 1, wherein at least one of the positive supply voltage and the negative supply voltage is ground.

4. The regulator of claim 1, wherein the first RF transistor and the second RF transistor are of at least one transistor construction selected from the group consisting of a Metal Oxide Field Effect Transistor (MOSFET), a Metal Semiconductor Field Effect Transistor (MESFET) and a bipolar transistor.

5. The regulator of claim 1, wherein a gain of the phase reversal circuit is configured to make the total gain of the second RF transistor and the phase reversal circuit substantially equal to the gain of the first RF transistor.

6. The regulator of claim 1, wherein the preamplifier stage and the phase reversal circuit are a single circuit comprising a non-inverting preamplifier electrically connected to the biasing terminal of the first RF transistor and an inverting preamplifier electrically connected to the biasing terminal of the second RF transistor.

7. The regulator of claim 1, wherein the first RF transistor and the second RF transistor of a type selected from the group consisting of n-type, npn, p-type and pnp.

8. The regulator of claim 1, wherein the first RF transistor and the second RF transistor have input capacitances of between about 20 and 200 pf.

9. The regulator of claim 1, wherein the first RF transistor and the second RF transistor have capacitances of between about 0.5 and 10 pf.

10. The regulator of claim 1, further comprising a switching regulator electrically connected to the linear regulator.

11. A regulator comprising:

a linear regulator comprising:

a preamplifier stage;

an output stage comprising:

a preamplifier stage;

a first radio frequency (RF) transistor;

a second RF transistor, wherein the first RF transistor and the second RF transistor are of the same type, wherein an output of the linear regulator is electrically connected to an input of the preamplifier stage, and wherein the first RF transistor and the second RF transistor are electrically connected in series between a positive supply voltage and a negative supply voltage; and a phase reversal circuit electrically connected between the preamplifier stage and the biasing terminal of the second RF transistor and configured to shift the phase of an output of the preamplifier by about 180°, wherein an output of the preamplifier stage is provided to a biasing terminal of the first RF transistor and to the phase reversal circuit, wherein the first and second RF transistors are connected such that:

when an input to the preamplifier stage is greater than the output of linear regulator, the first RF transistor sources current to a load to drive the output of the linear regulator higher;

when the input to the preamplifier stage is less than the output of the linear regulator, the second RF transistor sinks current from the load to drive the output of the linear regulator lower; and when an output current either sourced by the first RF transistor or sunk by the second RF transistor is equal to zero, the first RF transistor and the second RF transistor have a non-zero bias current; and a bias adjustment circuit configured to:

sense the bias current of the output stage, wherein the bias current of the output stage is a current of the first and second RF transistors when the output current of the output stage is substantially equal to zero;

compare the bias current to a reference bias current; and if the bias current does not have a predetermined relationship to the reference bias current, modify a dc shift of the output of the preamplifier stage.

12. The linear regulator of claim 11, wherein the predetermined relationship is that the bias current and the reference bias current are substantially equal.

13. The regulator of claim 11, further comprising a switching regulator electrically connected to the linear regulator.

14. The regulator of claim 11, wherein the bias adjustment circuit comprises at least one circuit type selected from the group consisting of a microprocessor circuit, a state machine circuit, and an analog circuit.

* * * * *